United States Patent [19]

Arisato et al.

[11] Patent Number: 4,867,091

[45] Date of Patent: Sep. 19, 1989

[54] SURFING BOOM

[75] Inventors: Toshiyuki Arisato; Masatoyo Okitsu; Toshio Mitsuyasu, all of Saitama, Japan

[73] Assignee: Somar Corporation, Tokyo, Japan

[21] Appl. No.: 103,157

[22] Filed: Oct. 1, 1987

[30] Foreign Application Priority Data

| | | | |
|---|---|---|---|
| Oct. 1, 1986 | [JP] | Japan | 61-233834 |
| Dec. 5, 1986 | [JP] | Japan | 61-290162 |
| May 19, 1987 | [JP] | Japan | 62-122895 |

[51] Int. Cl.[4] ..... B63B 35/00

[52] U.S. Cl. ..... 114/97

[58] Field of Search ..... 114/39.2, 89, 90, 91, 114/92, 93, 94, 95, 96

[56] References Cited

U.S. PATENT DOCUMENTS

| | | | |
|---|---|---|---|
| 4,530,299 | 7/1985 | Ross | 114/90 |
| 4,597,346 | 7/1986 | Pollard | 114/90 |
| 4,700,647 | 10/1987 | Pabsch | 114/89 |

FOREIGN PATENT DOCUMENTS

| | | | |
|---|---|---|---|
| 60989 | 4/1982 | Japan | 114/90 |

*Primary Examiner*—Sherman D. Basinger
*Assistant Examiner*—Stephen P. Avila
*Attorney, Agent, or Firm*—Sughrue, Mion, Zinn, Macpeak & Seas

[57] ABSTRACT

A surfing boom comprising a pipe of synthetic resin having a density of 1.4–1.6 g/cm$^3$. The pipe is reinforced by a plurality of carbon fiber layers. In a first carbon fiber layer, fibers are oriented within an angle of 60°–90° to an axial direction of the boom. In a second carbon fiber layer, fibers are oriented within an angle of 30° to the axial direction of boom.

6 Claims, 2 Drawing Sheets

SURFING BOOM

BACKGROUND OF THE INVENTION

This invention relates to a surfing boom of light weight which is excellent in mechanical strength.

In the wind-surfing, to steer a surfboard, a boom is used, which is formed by connecting both ends of two curved poles by means of joint in the form of a loop. For the formation of such booms, there has been used hitherto a curved pipe of aluminum alloy but such metallic booms are not satisfied in their light weight and strength. In the utility model laid-open No. 59-13396, a boom is proposed in which a pipe of aluminum alloy, in which the inside and outside of its curved portions are reinforced with a carbon fiber-reinforced plastics is used. Since the pipe surface of this boom is reinforced with a carbon fiber-reinforced plastics, it is lighter and improved in the hold maintenance by hand compared with the above-mentioned pipe of aluminum alloy. However, such boom is not yet satisfied in the light weight and the steering property because of using a pipe of aluminum alloy.

SUMMARY OF THE INVENTION

An object of this invention is to overcome such defects as mentioned above in the prior art surfing booms.

According to the invention, there is provided a surfing boom characterized by comprising a pipe of synthetic resin having a density of 1.4–1.6 g/cm$^3$ which is reinforced by a plurality of carbon fiber layers, said plurality of carbon fiber layers consisting of a carbon fiber layer, in which the direction of said carbon fibers is oriented within an angle of 60°–90° to the axial direction of boom, and a carbon fiber layer, in which said fibers are oriented within an angle of 30° to the axial direction of boom.

The "density" here is to be understood as the density of fiber-reinforced synthetic resin which constitutes the pipe.

According to another aspect of the invention, the boom main part and the joint pipe connecting to the boom main part and the like are formed as a synthetic resin pipe which is reinforced by a carbon fiber layer or both carbon fiber layer and synthetic fiber layer and an aluminum pipe is adhered to the inner surface of the portion where said pin-fitting holes and rivet-fitting holes as well as a plurality of pin-inserting holes are formed to keep the strength of said portion. That is to say, according to this invention, the characteristic of carbon fiber, which is resistant to the compression but weak in stretching, and the characteristic of aluminum, which is easily bent but shows a high resistance to stretching, are combined.

DETAILED DESCRIPTION OF THE PREFERRED EMBODIMENTS

Figure 1:
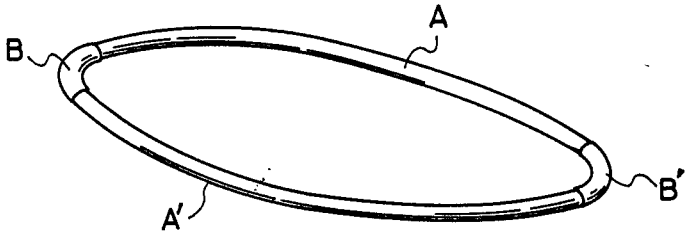
FIG. 1 shows an explanatory view of whole surfing boom according to a first embodiment of the invention.

The surfing boom according to the invention is thus explained with reference to drawings. FIG. 1 shows an explanatory view of said surfing boom and FIG. 2 shows a sectional view of synthetic resin pipe which constitutes a preferred surfing boom.

In FIG. 1, the surfing boom consists of boom main bodies A, A' and joints B, B' which connect both ends thereof.

Figure 2:
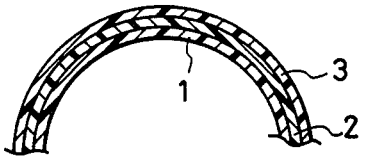
FIG. 2 is a section view of said boom.

In FIG. 2, numeral 1 denotes a carbon fiber layer forming the innermost layer, numeral 3 denotes a carbon fiber layer which is applied outside thereof and numeral 2 denotes a synthetic fiber layer intermediately between these layers. Each of these fiber layers is impregnated and cured with a liquid thermosetting resin such as an epoxy resin, an unsaturated polyester resin etc. as a matrix resin to form as a whole a pipe of fiber-reinforced synthetic resin.

Figure 3:
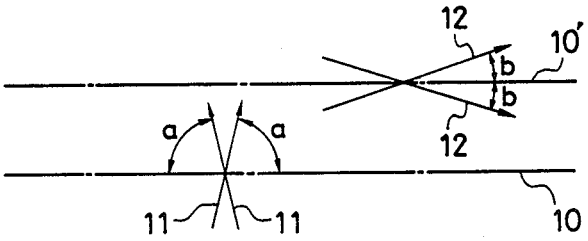
FIG. 3 is an explanatory view showing each direction of fiber in the innermost carbon fiber layer and the outer carbon fiber layer formed on the innermost layer.

I the innermost carbon fiber layer 1 among these carbon fiber layers, the direction of carbon fiber is oriented in an angle of 60°–90°, preferably about 90° to the axial direction of boom. That is, FIG. 3, the angle a of an arrow line 11 showing the direction of carbon fiber to the line 10 showing the axial direction of boom lies within a range of 60°–90°. The carbon fiber layer 1 in general consists of a coil winding of carbon fibers, for example, a winding formed by winding filaments, an assembly of fibers arranged in one direction, a web and the like. These windings may be used in combination with each other. Above all, a winding formed by a filament winding method is used preferably, which is formed according to the filament winding method by winding fibers with traversing them in general one time in the axial direction of boom. The winding with traversing more than two times may be employed and results in that fibers to be wound in the form of coil are wound while crossing in each layer. The thickness of said carbon fiber layer is in general 0.12–0.18 mm, preferably 0.14–0.16 mm.

The direction of carbon fiber in the carbon fiber layer 3 positioned outside the carbon fiber layer 1 is oriented within an angle of 30°, preferably 20°. That is, in FIG. 3, the angle b of an arrow line 12 showing the direction of carbon fiber to the line 10' showing the axial direction of boom lies within an angle less than 30°. The carbon fiber layer 3 consists in general of a web of carbon fiber, a winding formed by the filament winding method, an assembly of fibers arranged in one direction. These web and the like may be used in combination with each other. Above all, preferably a web is used. The thickness of carbon fiber layer 3 is in general 0.70–1.10 mm, preferably 0.80–0.95 mm.

By laminating the carbon fiber layers 1 and 3 in such manner that as mentioned above the direction of fiber is oriented in a specific direction, a boom excellent in the mechanical strength can be obtained in which one of the characteristic features of carbon fiber is shown sufficiently.

The synthetic fiber layer 2 interposed between the carbon fiber layers 1 and 3 is formed by using a synthetic fiber such as nylon, polyester, aramide, vinylon fiber and the like. The fibers in the synthetic fiber layer are oriented preferably in an angle less than 30° to the axial direction of boom. The synthetic fiber layer may be also formed with a web of synthetic fiber. The thickness of the synthetic fiber layer 2 is in general 0.25–0.38 mm, preferably 0.29–0.32 mm. Compared with the carbon fiber layers 1 and 3 the synthetic fiber layer 2 is excellent in the flexibility and elongation to prevent sudden break of boom and provides a structure of boom of improved stability. The synthetic fiber layer may be formed not only as an intermediate layer as mentioned above but also as the innermost or outermost layer.

In a preferred manufacture of boom having the section structure as shown in FIG. 2, a flexible core material having a smooth surface is wound with carbon fibers in a given thickness, a web of synthetic fiber is then arranged around the resulting winding and then a web of carbon fiber is arranged around thereon. The resulting fiber laminate is impregnated with a liquid thermosetting resin, the whole is bound with a film of good mold-releasing property, curved corresponding to a given form of boom and cured with heating in a furnace. After heat-curing, both the core material and the surface film are removed to yield a desired boom of carbon fiber-reinforced resin pipe. For the manufacture of such boom, various modifications may be available; for example, both carbon and synthetic fiber may be used as prepreg which is previously impregnated with a thermosetting resin or as winding which is formed by the filament winding method in which fibers are wound with impregnating with a synthetic resin, where the impregnation of said thermosetting resin may be omitted.

For the boom according to this invention as shown in FIG. 2, the sequence of lamination of each fiber layer and the construction of each fiber layer as shown in FIG. 1 are preferred and various modifications are available without restricting to those as shown in FIG. 1; for example, the synthetic fiber layer 2 is not necessarily used and may be dispeused with. Further, an additional carbon fiber layer may be laminated through a synthetic fiber layer on the carbon fiber layer 3.

The boom comprising said pipe of carbon fiber-reinforced synthetic resin according to this invention is of light weight (density: 1.4–1.6 g/cm$^3$) and highly excellent in the compression and bending strength. The outer diameter of the boom is in general about 29–33 mm so as to be held easily by hand and the thickness of the pipe is about 1.2–1.6 mm. The boom of such synthetic resin pipe cannot be broken by the compression under a load of people and it is confirmed that it has a superior bending strength to previous boom of aluminum alloy. The comparison of physical properties between the boom of synthetic resin pipe according to this invention and previous product (a pipe of aluminum alloy) is shown in the Table 1.

TABLE 1

| | Outer diameter (mm) | Thickness (mm) | Density (g/cm$^3$) | Weight per meter (g/m) | Relative Strength | |
|---|---|---|---|---|---|---|
| | | | | | Bending | Compression |
| Boom according to this invention | 31.8 | 1.35 | 1.5 | 185 | 1.5 | 1.1 |
| Previous product | 31.8 | 1.40 | 2.7 | 360 | 1 | 1 |

The surfing boom according to this invention has a structure in which both edges of two booms of said synthetic resin pipe are connected by means of common joints in the form of loop and, as mentioned above, is of light weight and excellent in the mechanical strength and in the holding maintenance, so that the steering of surfboard can be carried out safely and easily.

Figure 4:
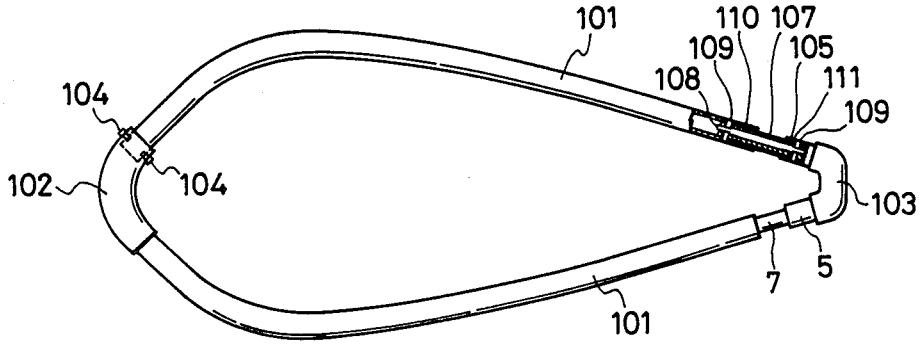
FIG. 4 is a plan view of surfing boom according to another embodiment of the invention.
Figure 5:
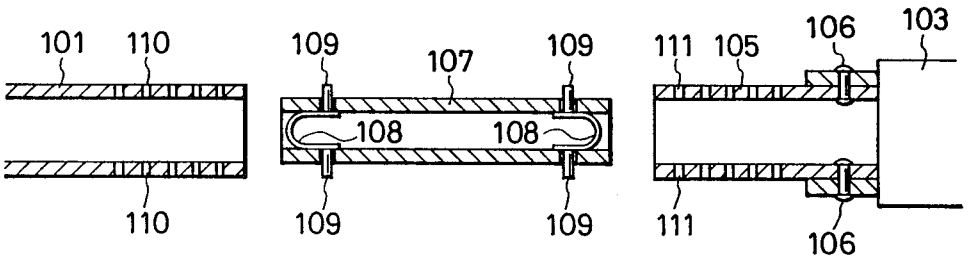
FIG. 5 is a plan sectional view in which the telescopic portion in FIG. 4 is shown separately.

A second embodiment of surfing boom according to this invention will be explained with reference to FIGS. 4 to 7. The entire boom, as shown in FIG. 4, is formed by connecting front and back edges of two outwards covered boom main parts 101, 101 by means of a jaw 102 and a connector 103 in the form of V respectively to form an endless frame, where the connection of boom main part with the jaw 102 is performed by means of rivets or pins 104 and the connection with the connector 103 by means of a plurality of holes and fitting-pins. Namely, as seen from FIG. 5, end pipes 105, 105 having the same diameter of boom main part 101 are fixed to the both ends of connector 103 by means of rivets 106, a joint pipe 107 is inserted from the front end of the end pipe 105 to the back end of the boom main part 101 and fitting pins 109, 109 which are fitted in the vicinity of both ends of joint pipe 107 and projected or retracted by spring 108 in the radial direction of the pipe, are fitted in several holes 110 . . . of boom main part and in several holes 111 . . . of end pipe 105 to fix each other.

The pipes such as boom main parts 101, 101 the joint pipe 107 and the end pipes 105, 105 are formed of synthetic resin, which is reinforced by means of a three fiber layer in which a synthetic fiber layer is held between two carbon fiber layers and in which an aluminum pipe is adhered as the innermost layer through a glass fiber-reinforced resin layer to the portion having said connecting holes.

Figure 6:
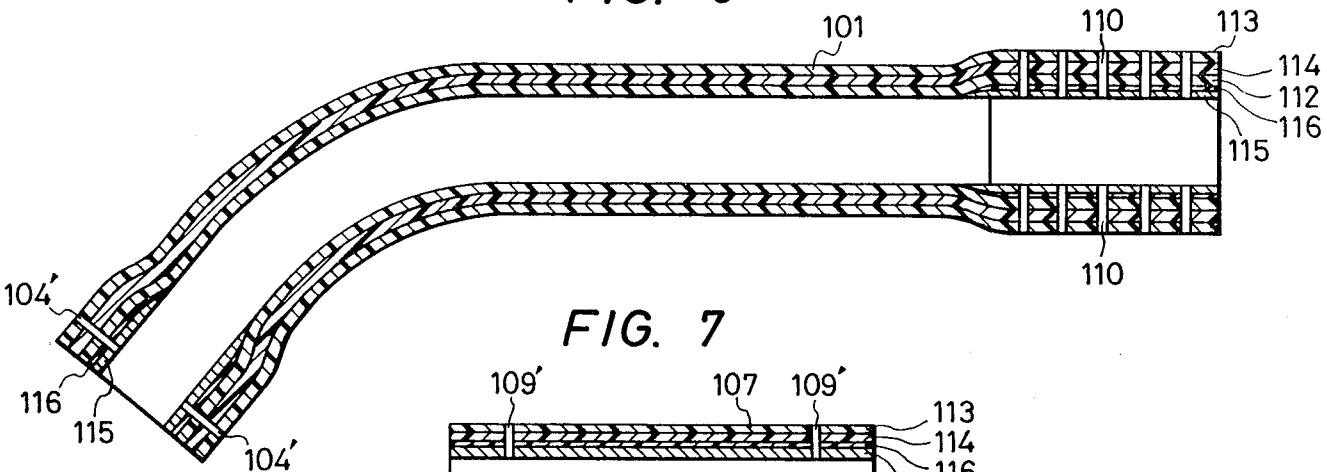
FIG. 6 is a plan sectional view of boom main part.
Figure 7:
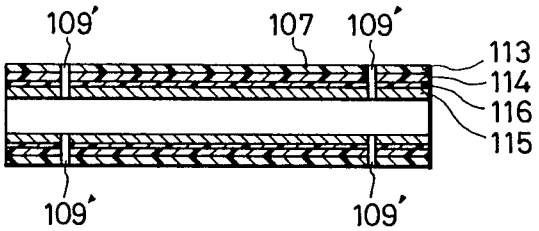
FIG. 7 is a plan sectional view showing the multilayer structure of the joint pipe.

FIG. 6 shows a sectional view of the boom main part 101 and FIG. 7 shows a sectional view of joint pipe 107; In the carbon fiber layer 112 forming the inner layer, the direction of carbon fiber is oriented in an angle of 60°–90°, generally near to 90° to the axial direction of pipe, and the layer 112 forms a winding in the form of a coil. The thickness thereof is in general 0.12–0.18 mm, preferably 0.14–0.16 mm. The carbon fiber layer 113 forming the outer layer is a web in which fibers are oriented in an angle within 30°, in general less than 20° to the axial direction of pipe and the thickness thereof is in general 0.70–1.10 mm, preferably 0.80–0.95 mm. The synthetic fiber layer 114 interposed between these carbon fiber layers 112, 113 is made of synthetic fiber such as nylon, polyester, aramide, vinylon fiber and the like and is excellent in the flexibility as intermediate. In the synthetic fiber layer, fibers are oriented preferably in an angle within 30° to the axial direction of pipe. The synthetic fiber layer may be formed by a web of synthetic fiber and the thickness of the layer is in general 0.25–0.38 mm, preferably 0.29–0.32 mm. Compared with the carbon fiber layer, the synthetic fiber layer is very excellent in the flexibility and elongation, prevents a rapid break of boom and provides a boom structure of improved stability. The synthetic fiber layer, as mentioned above, may be formed not only-as intermediate layer but also as innermost or outermost layer.

To the portion where connecting holes, i.e. holes 104' and 110 . . . for rivets 104 in the boom main part 101, holes 109', 109' for pins 109, 109 in the joint pipe 107 and holes 111 . . . in the end pipe 105 are formed respectively, an aluminum pipe 115 has a given thickness as the innermost layer is adhered through the glass fiber-reinforced resin layer 116 and the inner diameter is compressed into a given diameter. The glass fiber-reinforced resin layer is preferably through an insulating primer resin for example, such as thermosetting resins of phenol series and epoxy series, on the aluminum pipe 115. In this case, the primer resin layer improves the adhesion to the aluminum pipe and acts as an insulating layer to prevent the electric corrosion of aluminum pipe.

According to this invention, as mentioned above, an aluminum pipe (thickness: 0.4–1 mm) 115 is adhered through a glass fiber-reinforced resin layer 116 to the portion where connecting holes of boom are formed, so that said portion is very strong similar to the portion having no holes. The surfing boom according to this invention is, except the portion having said holes, a synthetic resin pipe (density: 1.4–1.6 g/cm$^3$) in which a synthetic fiber-reinforced resin layer 114 is interposed between carbon fiber-reinforced resin layers 112, 113, in which the direction of fiber is different each other. Thus, the surfing boom according to this invention is excellent 1.5 times in the bending strength and 1.1 times in the compression strength and about 0.5 times in the weight compared with the previous boom of aluminum alloy pipe, resulting in that the whole of boom is strong and of light weight.

The matrix resin forming the boom main part 101 and the joint pipe 107 in this invention is a cured epoxy or unsaturated polyester resin and the like. The boom main part according to this invention may be formed by only the carbon fiber-reinforced resin layer with excluding the synthetic fiber-reinforced resin layer.

We claim:

1. A surfing boom comprising a pipe of synthetic resin having a density of 1.4–1.6 g/cm$^3$ which is reinforced by a plurality of carbon fiber layers, said plurality of carbon fiber layers composed of a first carbon fiber layer, in which fibers are oriented within an angle of 60°–90° to an axial direction of the boom, and a second carbon fiber layer, in which fibers are oriented within an angle of 30° to the axial direction of said boom, said pipe having uniform thickness in a plane transverse to said axial direction of the boom.

2. A surfing boom comprising a pipe of synthetic resin having a density of 1.4–1.6 g/cm$^3$ which is reinforced by a plurality of carbon fiber layers and synthetic fiber layers, said plurality of carbon fiber layers composed of a first carbon fiber layer, in which fibers are oriented within an angle of 60°–90° to the axial direction of said boom, and a second carbon fiber layer, in which fibers are oriented within an angle of 30° to the axial direction of said boom, said pipe having uniform thickness in a plane transverse to said axial direction of said boom.

3. A surfing boom according to claim 2 in which fibers in said synthetic fiber layer are oriented within an angle of 30° to the axial direction of boom.

4. A surfing boom comprising two outwardly curved main boom parts, wherein front ends thereof are connected by means of a jaw by one of riveting and pinning and back ends thereof are connected by means of a connector through end pipes, each of which is connected to a joint pipe, each of said back ends of said boom being connected to said joint pipe by means of holes formed in the radial direction of said boom and pins to be fitted in said holes, characterized in that both main boom parts and said joint pipe are formed as pipes of synthetic resin which are reinforced by a carbon fiber layer or both a carbon fiber layer and synthetic fiber layer, and an aluminum pipe is applied through a layer of glass fiber-reinforced resin to the inner surface of the portion having said holes, said pipe having uniform thickness in a plane transverse to the axial direction of said boom.

5. A surfing boom having a surfing boom main part comprising a synthetic resin pipe reinforced by a carbon fiber layer or both a carbon fiber layer and synthetic fiber layer, and having connecting holes formed at both ends of said synthetic resin pipe in the radial direction and a pipe of aluminum is adhered through a layer of glass fiber-reinforced resin to the inner surface of the portion having said connecting holes, said pipes having uniform thickness in a plane transverse to the axial direction of said boom.

6. A surfing boom comprising a joint pipe having a straight synthetic resin pipe which is reinforced by a carbon fiber layer or both carbon fiber layer and synthetic fiber layer, both ends of said synthetic resin pipe having connecting holes being formed in the diameter direction and a pipe of aluminum is adhered through a glass fiber-reinforced resin layer to the inner surface of the portion having said connecting holes, wherein said joint pipe has a uniform thickness in a plane transverse to an axial direction of said boom.

* * * * *